US006798386B1

(12) United States Patent
Louzir

(10) Patent No.: US 6,798,386 B1
(45) Date of Patent: Sep. 28, 2004

(54) SYSTEM WITH MULTIPLE SOURCE ANTENNAS INTEGRATED WITH A LOW-NOISE FREQUENCY CONVERTER

(75) Inventor: Ali Louzir, Strasbourg (FR)

(73) Assignee: Thomson Licensing, S.A., Boulogne-Billancourt (FR)

( * ) Notice: Subject to any disclaimer, the term of this patent is extended or adjusted under 35 U.S.C. 154(b) by 0 days.

(21) Appl. No.: 08/534,492

(22) Filed: Sep. 27, 1995

(30) Foreign Application Priority Data

Oct. 10, 1994 (FR) ..... 94 12082

(51) Int. Cl.[7] ..... H01Q 19/12
(52) U.S. Cl. ..... 343/840; 343/770; 343/769
(58) Field of Search ..... 343/840, 767, 343/700 MS, 768, 769, 770; H01Q 19/12

(56) References Cited

U.S. PATENT DOCUMENTS 4,195,301 A * 3/1980 Conroy ..... 343/840
4,712,111 A 12/1987 Ohta et al.
5,084,711 A * 1/1992 Moss et al. ..... 343/911 L
5,202,700 A 4/1993 Miller ..... 343/840
5,402,138 A * 3/1995 Hulett et al. ..... 343/840

FOREIGN PATENT DOCUMENTS

| | | | |
|---|---|---|---|
| DE | 3605195 | 8/1987 | ..... H01Q/3/24 |
| EP | 0516981 | 12/1992 | ..... H01Q/21/06 |
| EP | 0682383 | 11/1995 | |
| GB | 2266190 | 10/1993 | ..... H01Q/3/24 |
| WO | WO94/19842 | 1/1994 | |

* cited by examiner

*Primary Examiner*—Hoanganh Le
(74) *Attorney, Agent, or Firm*—Joseph S. Tripoli; Reitseng Lin

(57) ABSTRACT

The invention relates to a device for receiving signals transmitted by N satellites, the said device comprising means for focusing the beams corresponding to the said signals. The device comprises several source antennas, the said source antennas being printed antennas made on a single substrate.

9 Claims, 4 Drawing Sheets

SYSTEM WITH MULTIPLE SOURCE ANTENNAS INTEGRATED WITH A LOW-NOISE FREQUENCY CONVERTER

FIELD OF THE INVENTION

The invention relates to a reception device comprising a low-noise frequency converter incorporating several source antennae (or "feeds"). The invention applies in particular in the reception of signals transmitted by several satellites.

BACKGROUND OF THE INVENTION

The reception of signals transmitted by geostationary satellites, for example satellites relaying television transmissions, is conventionally carried out with the aid of a parabola which concentrates the received beam at its focal point. A waveguide source antenna is then placed appropriately relative to the parabola so as to couple the signal received to one or more probes which transmit it to a low-noise frequency converter. The latter carries out the conversion of the signal into intermediate frequency, the converted signal being processable by satellite demodulator and/or the decoder of the receiver.

In the case in which it is desired to aim at several closely spaced geostationary satellites, several solutions are currently used. The most obvious solution, although not the most economical, is to use as many parabola as there are satellites. Another solution, suitable for the reception of signals transmitted by two closely spaced satellites, consists in using a single parabola, but with two waveguide source antennas and two frequency converters. The parabola then points either at one of the satellites, or at a position intermediate between the two. The beams emitted by the two satellites and reflected by the parabola then converge at two distinct points. The fact that, in this case, at least one of the signals is not focused optimally, results in impaired reception. Moreover, if the satellites are closely spaced, the points of convergence of the beams are likewise closely spaced, this closeness being all the greater the smaller the parabola. The problem then arises of the side-by-side positioning of the waveguides, whose dimensions are difficult to modify. Certain products on the market undertake a merging of the extremities of the waveguides, and this impairs the quality of reception even further by increasing the coupling between the beams. Moreover, the presence of several frequency converters raises the cost of the product.

There are also "paraboloidal"reflectors whose role is to improve the convergence of beams originating from several satellites which are more or less closely spaced. The reflectors are then designed so as to present a substantially parabolic surface to each beam.

SUMMARY OF THE INVENTION

The situation in which a number of satellites are very closely spaced angularly is a far from exceptional situation which will become more and more frequent as the geostationary orbit becomes congested. An example of a "cluster" of satellites in Europe is the collection of Eutelsat satellites.

The subject of the invention is a device for receiving signals transmitted by N (N>1) satellites comprising means for focusing the beams corresponding to the said signals, characterized in that it comprises several source antennas, the said antennas being printed source antennae made on a single substrate.

The use of several slot antennae printed on a substrate makes it possible to overcome the problems related to the use of waveguides.

According to a particular embodiment, the arrangement of the said antennas on the said substrate is determined by the location of the points of focusing of the said beams.

Moreover, the positioning of the antennas on the substrate is determined by the arrangement of the best points of focusing available for each beam. When installing the parabola and the antennas, it will suffice to position these reception means correctly while referring to a single satellite. The positioning in respect of the other satellites is then carried out automatically.

According to a particular embodiment, the focusing means comprise an electromagnetic lens, for example a lens of Luneburg type (hemispherical lens).

Such a lens makes it possible to obtain optimal convergence of all the beams, unlike a parabola which possesses only one true focal point.

According to another particular embodiment, the means for focusing the beams comprise a parabolic reflector. For satellites which are relatively closely spaced, one parabola can be regarded as sufficient to focus the various beams adequately. For larger angular spacings, the Luneburg type lens is more suitable.

According to a particular embodiment, the means of focusing being a parabolic reflector, a first antenna is placed at the focal point of the reflector, the other antennas being placed on one side or on the other with respect to the first antenna.

According to a particular embodiment, the antennas are slot antennas.

According to the particular embodiment, the antennas are annular-slot antennas.

This form of antenna is particularly suitable for the reception of orthogonally polarized waves having linear or circular polarizations.

According to a particular embodiment, the said device comprises at least one frequency converter made on the same substrate as the said antennas.

According to a particular embodiment, the device comprises multiplexing means which multiplex the signals received by the antennas towards a frequency converter.

Thus, a single frequency converter is required. This results in a very substantial saving in space and in components.

According to a particular embodiment, the said frequency converter is made on the same substrate as the antennas.

BRIEF DESCRIPTION OF DRAWINGS

Other characteristics and advantages of the invention will emerge through the description of two non-limiting particular embodiments illustrated by the attached figures, among which.

DETAILED DESCRIPTION OF INVENTION

Figure 1:
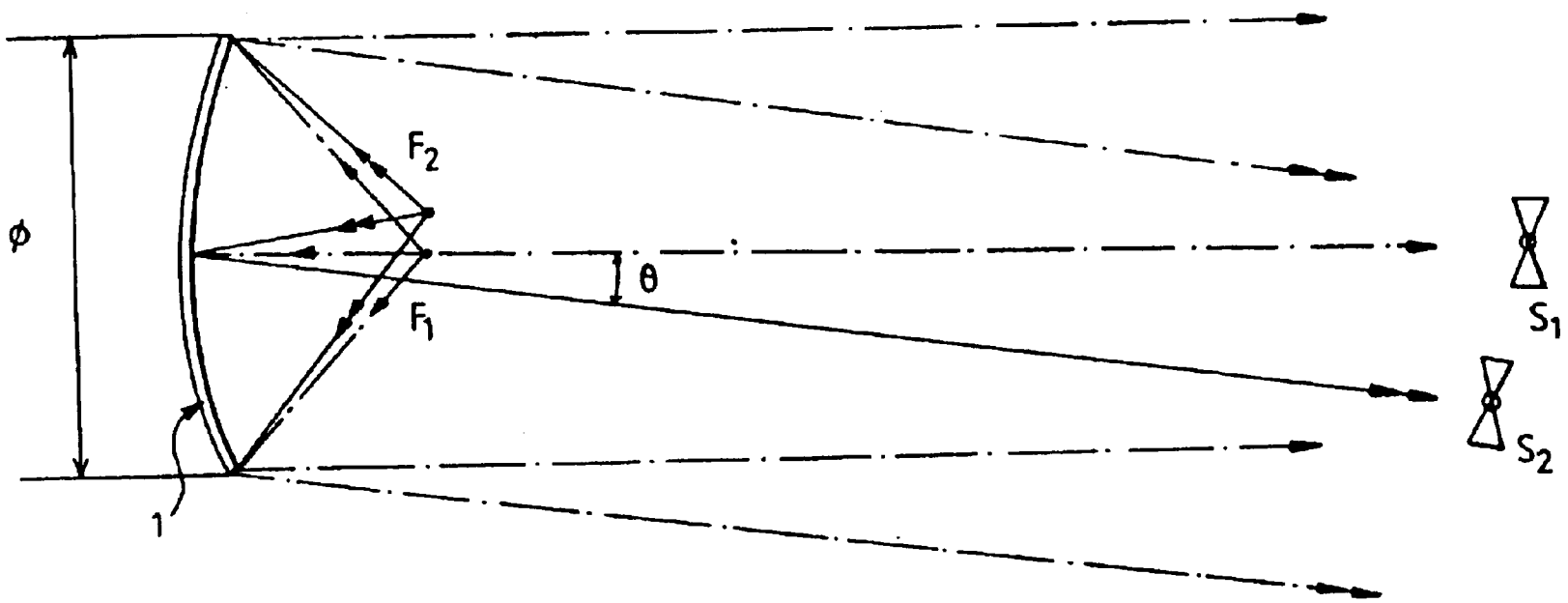
FIG. 1 represents diagrammatically the points of convergence in the vicinity of a parabolic reflector for beams emitted by two angularly closely spaced satellites.

FIG. 1 explains the position of the optimal points of convergence in the vicinity of a parabolic reflector when the latter reflects the beams emitted by two satellites angularly spaced by an angle θ. A parabola 1 of diameter Ø possesses a focal point F1. The parabola is assumed to be oriented in such a way that ideally a satellite S1 is situated on the axis of the parabola and that the waveplane of this beam is perpendicular to this axis. The reflected beam converges at F1, lying on the axis of the parabola.

A second satellite S2 transmits a second beam whose waveplane is inclined by the angle θ relative to the axis of the parabola. The optimum point of convergence lies on a straight line inclined by the angle θ relative to the axis.

Figure 2:
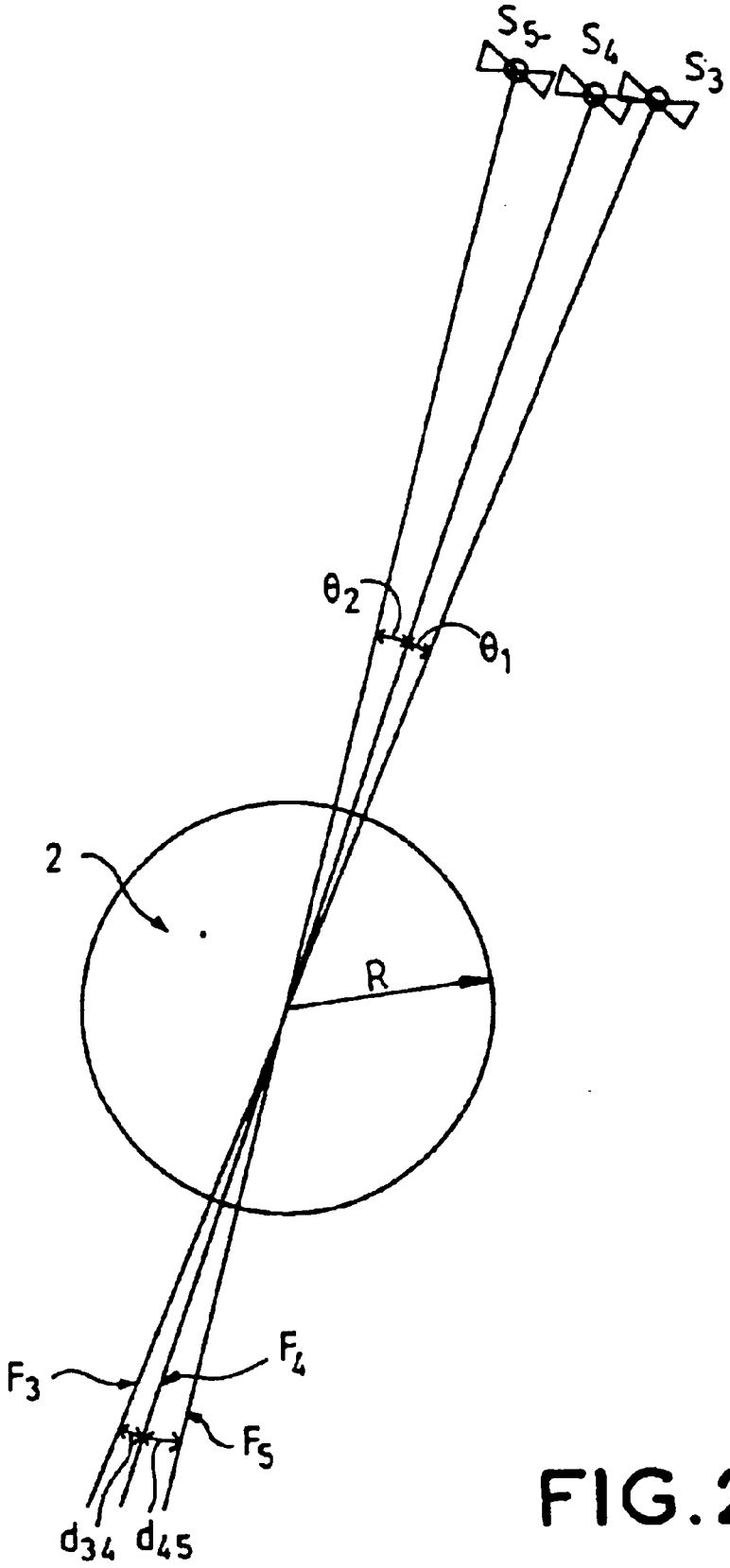
FIG. 2 represents diagrammatically the focal points in the vicinity of a Luneburg type lens for beams emitted by three satellites.

FIG. 2 explains the position of the focal points in the case of the use of a Luneburg type lens. For clarity of representation, the lens 2 has the shape of a sphere, thus enabling the object points and corresponding image points to be represented on one side and on the other of the said sphere. The practical implementation will employ a hemisphere on a reflector plane.

The Luneburg type lens has a radius R. The focal points lie around 1.5×R from the centre of the lens. A focal point lies on the straight line parallel to the beam which illuminates the lens and passing through the centre of the latter. As was mentioned earlier, the advantage of the lens over the parabola is that it has as many focal points as there are signal sources. There is no defocusing, given the spherical symmetry of the lens.

Strictly speaking, a Luneburg lens has its focal points in the vicinity of the surface of the lens. An approximation used here allows these focal points to be shifted to 1.5 times the radius. The separation between the focal points is thus improved.

Three satellites S3, S4, S5 are angularly spaced by θ1 and θ2 respectively. To these three satellites there correspond focal points F3, F4 and F5 respectively. If the angles θ1 and θ2 are regarded as small (less than 5° for example), the linear distances d34 and d45 respectively separating F3 from F4 and F4 from F5 are substantially equal to 1.5Rè1 and 1.5Rè2 in metres, where θ1 and θ2 are given in radians.

For a lens 30 centimetres in radius and angles of 3°, the linear distances are equal to around 2.4 centimetres.

For the sake of clarity in FIG. 2, the distance between the focal points and the centre of the lens is not to scale relative to the radius R of this same lens.

Figure 3:
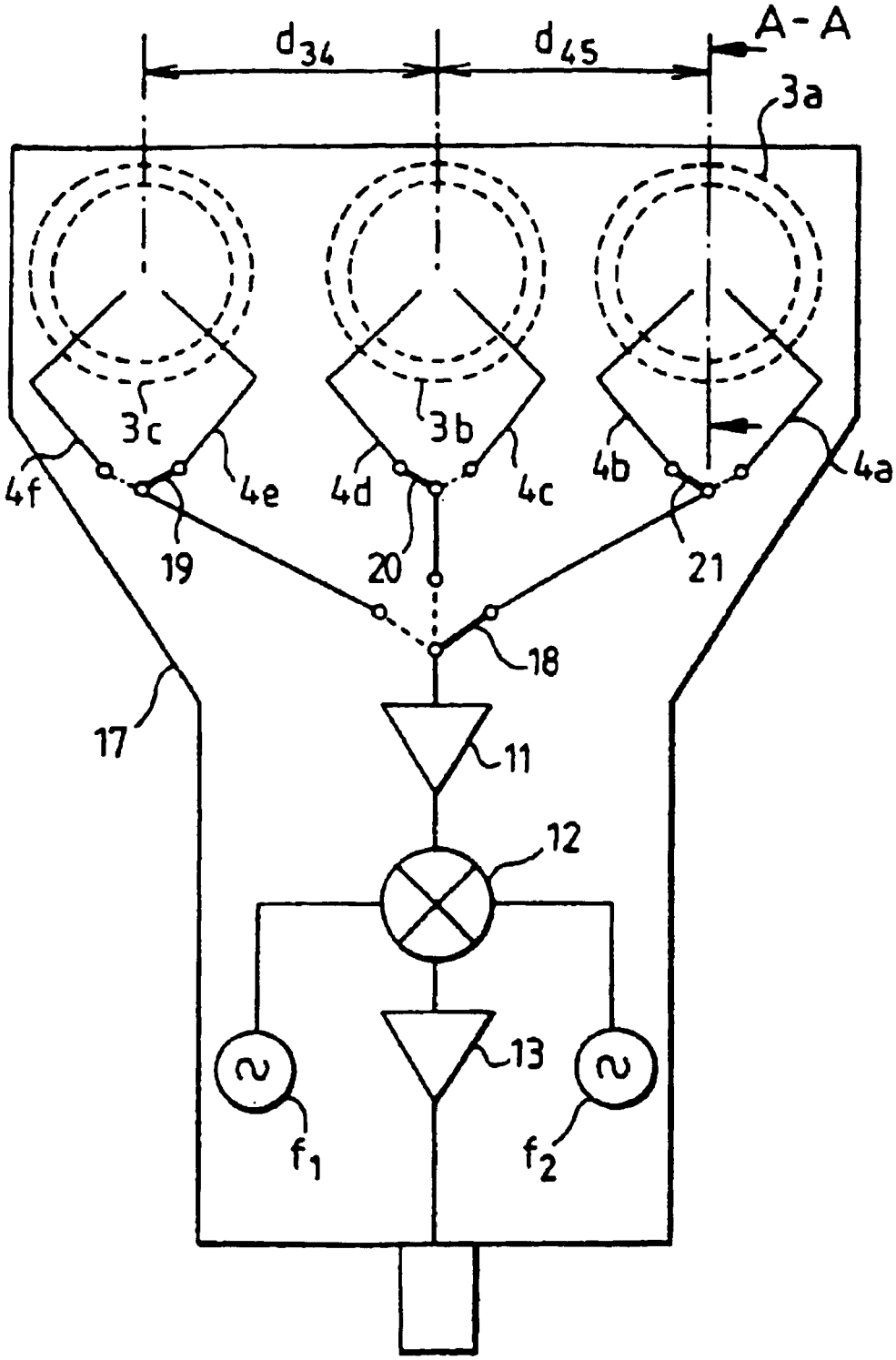
FIG. 3 represents diagrammatically an exemplary embodiment of the device in accordance with the invention for reception within the context of the configuration of FIG. 2.

An exemplary embodiment of the device in accordance with the invention is illustrated in FIG. 3. The example illustrated relates to a device for receiving signals originating from three satellites, for example the satellites S3, S4 and S5 of FIG. 2. Those skilled in the art will adapt the invention to other appropriate cases, such as that of FIG. 1.

The device comprises a dielectric substrate 17 which supports three annular-slot antennae 3*a*, 3*b*, 3*c* etched directly on the substrate. These antennae are excited by microstrip lines 4*a* to 4*f* in a manner described later. The centres of the slots are positioned on the substrate in such a way that the distances which separate them are equal to the distances which separate the focal points F3, F4 and F5.

A radio frequency amplifier 11 amplifies one of the signals originating from the microstrip lines. This signal is transmitted to a mixer 12, receiving one of the frequencies F1 or F2 from appropriate oscillators. The signal output by the mixer is amplified by an intermediate-frequency amplifier 13, before being transmitted, for example by coaxial cable (not illustrated), to an interior unit (demodulator, decoder, TV receiver).

Figure 4:
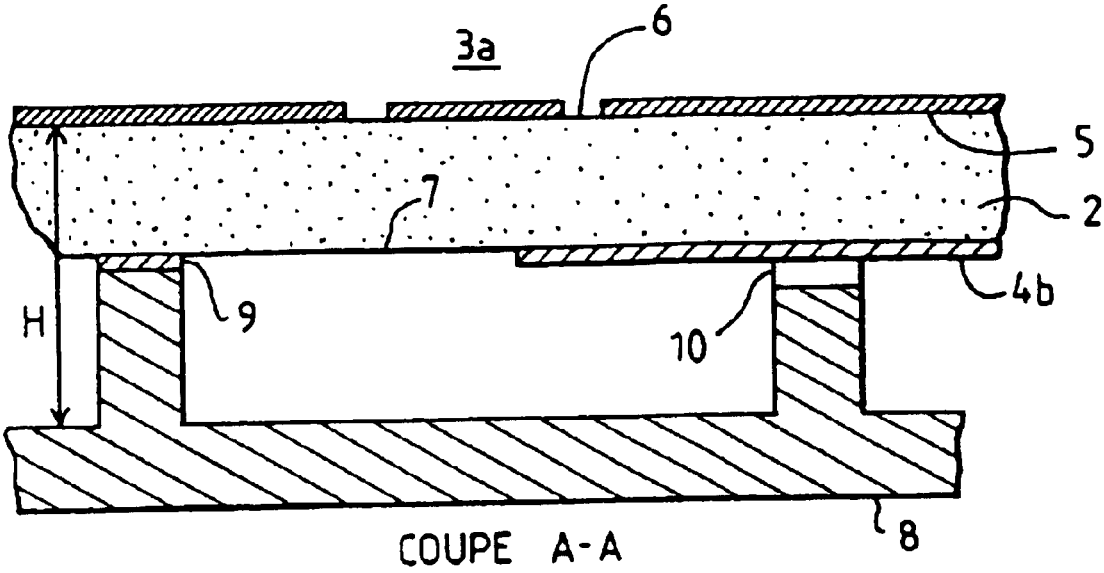
FIG. 4 represents a variant embodiment enlisting a section through FIG. 3.

FIG. 4 illustrates a section through FIG. 3, through the centre of the annular slot 3*a*. This figure illustrates a variant embodiment, certain elements of which do not appear in FIG. 3. The side 5 of the dielectric substrate is covered with a metallic layer in which an annulus 6 is etched. As a first approximation, the resonant modes of the slot occur at frequencies for which the circumference of the slot is equal to an integer multiple of the guided wavelength.

The metallic layer is connected to earth. According to a particular embodiment, the substrate is oriented in such a way as to present the annular slots to the reflector.

The side 7 of the substrate includes the slot excitation means. In FIG. 4, the microstrip line 4*b* can be seen. This microstrip line penetrates at right angles into the enclosure formed by the annular slot 6, of a depth which is of the order of one quarter of the guided wavelength. Right-angled penetration corresponds to maximum coupling. The dimensions of the microstrip lines are optimized in such a way as to exhibit a wide passband around the operating frequency. In particular, they exhibit a narrowing (not illustrated) before penetrating into the enclosure formed by the annular slot.

According to a particular embodiment, a base 8 is arranged on the face 7 of the substrate. The function of this base, which is not illustrated in FIG. 3, is to make it possible to obtain a wave antinode in the vicinity of the annular slot. The base is formed by a conducting cavity connected to the metallic plane of the face 5 by way of a conducting line 9. An orifice 10 allows the microstrip line 4*b* to penetrate inside the base 8 while being electrically insulated therefrom. The depth H of the base is equal to around a quarter of the guided wavelength. The thickness of the substrate and of the metallic planes has been exaggerated in FIG. 4 so as better to highlight the characteristics described.

According to the present exemplary embodiment and returning to FIG. 3, each annular slot is provided with two microstrip lines arranged at right angles, thus allowing reception of horizontally and vertically linearly polarized waves. Six signals are thus procured, available at the extremity of each microstrip line 4*a* to 4*f* respectively. Multiplexing means (represented diagrammatically by switches 18 to 21 and by dashes indicating the possible connections) allow the selection of one of these signals for transmission to the amplifier 11. These multiplexing means are for example blocker amplifiers whose passing or blocking state is controlled by a DC voltage.

For greater clarity in the drawings, the base 8 does not appear in FIG. 3.

Figure 5:
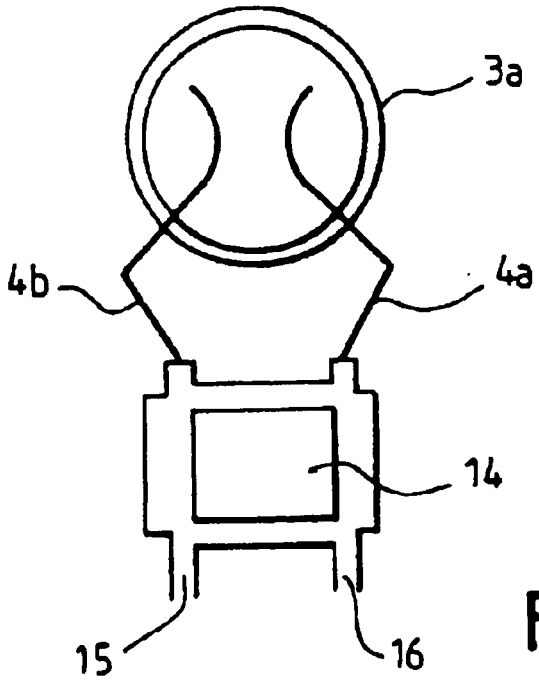
FIG. 5 represents diagrammatically a hybrid coupler used for coupling circularly polarized waves.

To receive counterclockwise or clockwise circularly polarized waves a hybrid coupler is interposed between each annular slot and the multiplexing means. The coupler 14 is illustrated in FIG. 5. This hybrid coupler is fed via two microstrip lines 4*a* and 4*b*. The length of each of the sides of the coupler is around a quarter of the wavelength of the guided wave.

It will be noted that the extremities of the two microstrip lines are bent back into the enclosure of the annular slot so as to avoid undesirable coupling between the guided components.

Let $(o,\vec{i},\vec{j})$ be an orthonormal reference frame, o being the centre of the annular slot 3*a*, $\vec{i}$ and $\vec{j}$ being vectors respectively parallel to the segments of the microstrip lines 4*a* and 4*b* penetrating perpendicularly into the enclosure formed by the slot.

A signal V=Acos(ωt) present at the port 16 produces, at the ports connected to the lines 4*a* and 4*b*, signals respectively of the form:

$$Vx = \frac{A}{\sqrt{2}}\cos(\omega t + \varphi)$$

$$Vy = \frac{A}{\sqrt{2}}\cos\left(\omega t + \varphi - \frac{\pi}{2}\right)$$

The voltages Vx and Vy give rise by coupling to the slot to fields of the form:

$$\overline{E}x \equiv \frac{A}{\sqrt{2}}\cos(\omega t + \varphi)\overline{i}$$

$$\overline{E}y \equiv \frac{A}{\sqrt{2}}\sin(\omega t + \varphi)\overline{j}$$

The total radiated field corresponds to the sum of these two fields. It can be verified that the sum vector turns counterclockwise and that the tip of this vector describes a circle.

By reciprocity, a wave with left-handed circular polarization coupled to the slot 3*a* will give rise to a voltage V-Acos(ωt) at the port 16.

According to a particular embodiment, the reflector used in conjunction with the invention is a paraboloidal reflector intended to improve the focusing of the various beams.

Finally, the slot antennae may have shapes other than annular, depending on the type of wave and polarization to be Those skilled in the art will readily be able to adapt the invention to the various configurations which may occur.

What is claimed is:

1. Device for receiving signals transmitted by N (N>1) satellites comprising:

means for focusing a plurality of beams, each beam corresponding to one of said signals, and a plurality of source antennas, the source antennas being printed antennas formed on a single substrate, the arrangement of each of said antennas on said substrate being determined by the location of an optimum point of convergence of a different one of said beams.

2. Device according to claim 1, wherein the means for focusing comprise an electromagnetic lens.

3. Device according to claim 1, wherein the means for focusing comprise a parabolic reflector.

4. Device according to claim 3, wherein a first source antenna is placed at a focal point of the said reflector, the other antennas being placed on one side or on another side with respect to the said first antenna.

5. Device according to claim 1, wherein the antennas are slot antennas.

6. Device according to claim 5, wherein the antennas are annular-slot antennas.

7. Device according to claim 1, wherein the device further comprises multiplexing means which multiplex the signals received by the antennas and couple said signals to a frequency converter.

8. Device according to claim 7, wherein the frequency converter is disposed on the same substrate as the antennas are slot antennas.

9. Device according to claim 1, further comprising at least one frequency converter disposed on the same substrate as the antennas.

* * * * *